US009892677B2

(12) United States Patent
Jeong et al.

(10) Patent No.: US 9,892,677 B2
(45) Date of Patent: Feb. 13, 2018

(54) ORGANIC LIGHT EMITTING DIODE DISPLAY

(71) Applicant: LG DISPLAY CO., LTD., Seoul (KR)

(72) Inventors: Hoyoung Jeong, Goyang-si (KR); Bokyoung Lee, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 99 days.

(21) Appl. No.: 14/946,354

(22) Filed: Nov. 19, 2015

(65) Prior Publication Data

US 2016/0140899 A1 May 19, 2016

(30) Foreign Application Priority Data

Nov. 19, 2014 (KR) ..... 10-2014-0161905

(51) Int. Cl.
*G09G 3/32* (2016.01)
*G09G 3/3225* (2016.01)

(52) U.S. Cl.
CPC ..... *G09G 3/3225* (2013.01); *G09G 2300/043* (2013.01); *G09G 2300/0426* (2013.01); *G09G 2300/0439* (2013.01); *G09G 2300/0809* (2013.01); *G09G 2320/045* (2013.01); *G09G 2330/023* (2013.01); *G09G 2330/028* (2013.01); *G09G 2330/12* (2013.01); *G09G 2360/144* (2013.01)

(58) Field of Classification Search
CPC combination set(s) only.
See application file for complete search history.

(56) References Cited

U.S. PATENT DOCUMENTS

2008/0150887 A1* 6/2008 Kim ..... G02F 1/167 345/107
2008/0266214 A1* 10/2008 Naugler ..... G09G 3/3225 345/76
2014/0125714 A1* 5/2014 Pyo ..... G09G 3/3233 345/691

(Continued)

FOREIGN PATENT DOCUMENTS

CN 102810551 A 12/2012
CN 202769509 U 3/2013

(Continued)

OTHER PUBLICATIONS

J.C. Bernede, "Organic Photovoltaic Cells: History, Principle and Techniques," J. Chil. Chem. Soc., 53, No. 3, 2008, pp. 1549-1564.

*Primary Examiner* — Van Chow
(74) *Attorney, Agent, or Firm* — Birch, Stewart, Kolasch & Birch, LLP

(57) ABSTRACT

An organic light emitting diode display is discussed. The organic light emitting diode display according to an embodiment a plurality of pixels configured to operate in an image mode for displaying images, and in an electricity generation mode for generating an electric current. Each pixel includes an organic light emitting diode and a pixel driving circuit. The pixel driving circuit electrically separates the corresponding light emitting diode from one or more adjacent organic light emitting diodes in the image mode, and electrically connects the corresponding light emitting diode to the one or more adjacent organic light emitting diodes in the electricity generation mode.

12 Claims, 4 Drawing Sheets

(56) References Cited

U.S. PATENT DOCUMENTS

| | | | | |
|---|---|---|---|---|
| 2014/0240342 | A1* | 8/2014 | Xu | G09G 3/36 345/590 |
| 2016/0140902 | A1* | 5/2016 | Yang | G09G 3/3258 345/78 |
| 2016/0155370 | A1* | 6/2016 | Kimura | G09G 3/3258 345/213 |
| 2016/0203761 | A1* | 7/2016 | Zhang | G09G 3/3233 345/690 |

FOREIGN PATENT DOCUMENTS

| | | | |
|---|---|---|---|
| CN | 103295521 | A | 9/2013 |
| KR | 10-2014-0058283 | A | 5/2014 |
| WO | WO 2008/134101 | A1 | 11/2008 |

* cited by examiner

ORGANIC LIGHT EMITTING DIODE DISPLAY

This application claims the priority benefit of Korean Patent Application No. 10-2014-0161905 filed on Nov. 19, 2014, the entire contents of which is incorporated herein by reference for all purposes as if fully set forth herein.

BACKGROUND OF THE INVENTION

Field of the Invention

Embodiments of the invention relate to an organic light emitting diode display having an electricity generation function.

Discussion of the Related Art

Since an organic light emitting diode (OLED) display is a self-emission display device, the OLED display may be manufactured to have lower power consumption and a thinner profile than a liquid crystal display requiring a backlight unit. Further, the OLED display has advantages of a wide viewing angle and a fast response time. The process technology of the OLED display has also been developed for large-screen mass productions. As a result, the OLED display has expanded its market while competing with the liquid crystal display.

According to a related art, each pixel of the OLED display includes an organic light emitting diode (OLED) having a self-emitting structure. As shown in FIG. 1, organic compound layers including a hole injection layer HIL, a hole transport layer HTL, an emission layer EML, an electron transport layer ETL, an electron injection layer EIL, etc. are stacked between an anode and a cathode of the OLED. The OLED display implements an input image using a phenomenon in which the OLED emits light when electrons and holes are combined in an organic layer through a current flowing in a fluorescence or phosphorescence organic thin film.

The OLED display may be variously classified depending on the kinds of emission materials, an emission method, an emission structure, a driving method, and the like. The OLED display may be classified into a fluorescent emission type and a phosphorescent emission type depending on the emission method. Further, the OLED display may be classified into a top emission type and a bottom emission type depending on the emission structure. Further, the OLED display may be classified into a passive matrix OLED (PMOLED) display and an active matrix OLED (AMOLED) display depending on the driving method.

Each pixel of the OLED display includes a driving thin film transistor (TFT) for controlling a driving current flowing in the OLED depending on data of the input image. Characteristics such as a threshold voltage and a mobility of the driving TFT have to be uniformly designed in each and all of the pixels of the OLED display, but generally are not uniform depending on a process deviation, a driving time, a driving environment, etc. Thus, the OLED display has adopted a compensation technology for sensing changes in the driving characteristics of the pixels to properly modify input data based on the sensed result. The changes in the driving characteristics of the pixel include changes in the characteristics of the driving TFT including the threshold voltage, the mobility, etc. of the driving TFT.

The structure of the OLED is similar to the structure of a battery cell of an organic solar cell. A study has been proposed to combine the OLED and the organic solar cell and generate electric power of the organic solar cell using light of the OLED. However, such a study has to involve studying the changes in the structure of the OLED. Therefore, the proposal results in an increase in the manufacturing cost of the display device and makes it difficult to achieve lightness in weight and the thin profile of the display device.

SUMMARY OF THE INVENTION

Embodiments of the invention provide an organic light emitting diode display capable of generating electric power using an organic light emitting diode.

Embodiments of the present invention provide an organic light emitting diode display which addresses the limitations associated with the related art.

In one aspect, there is an organic light emitting diode display including a plurality of pixels, each pixel including an organic light emitting diode and a pixel driving circuit configured to cause the organic light emitting diode to emit light depending on a data voltage of an input image in an image mode and supply a current generated in the organic light emitting diode to a battery in an electricity generation mode.

In one aspect, the pixel driving circuit can electrically separate adjacent organic light emitting diodes from one another in the image mode. On the other hand, the pixel driving circuit can electrically connect the adjacent organic light emitting diodes to each other and electrically connect these adjacent organic light emitting diodes to the battery in the electricity generation mode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention. Further, when two components are discussed to be connected, these components can be said to be electrically connected to each other, physically connected to each other (directly or indirectly), or both, as applicable.

Figure 2:
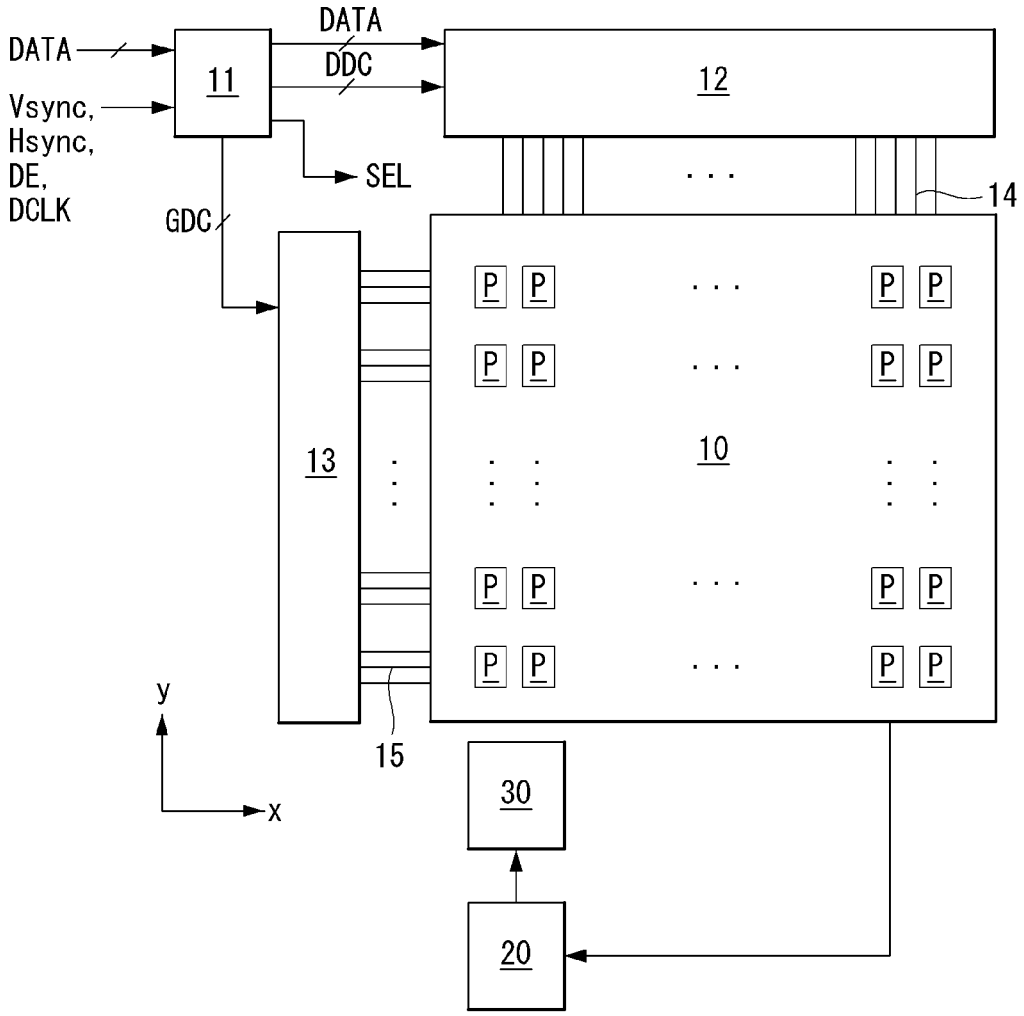
FIG. 2 is a block diagram of an organic light emitting diode display according to an embodiment of the invention.
Figure 3:
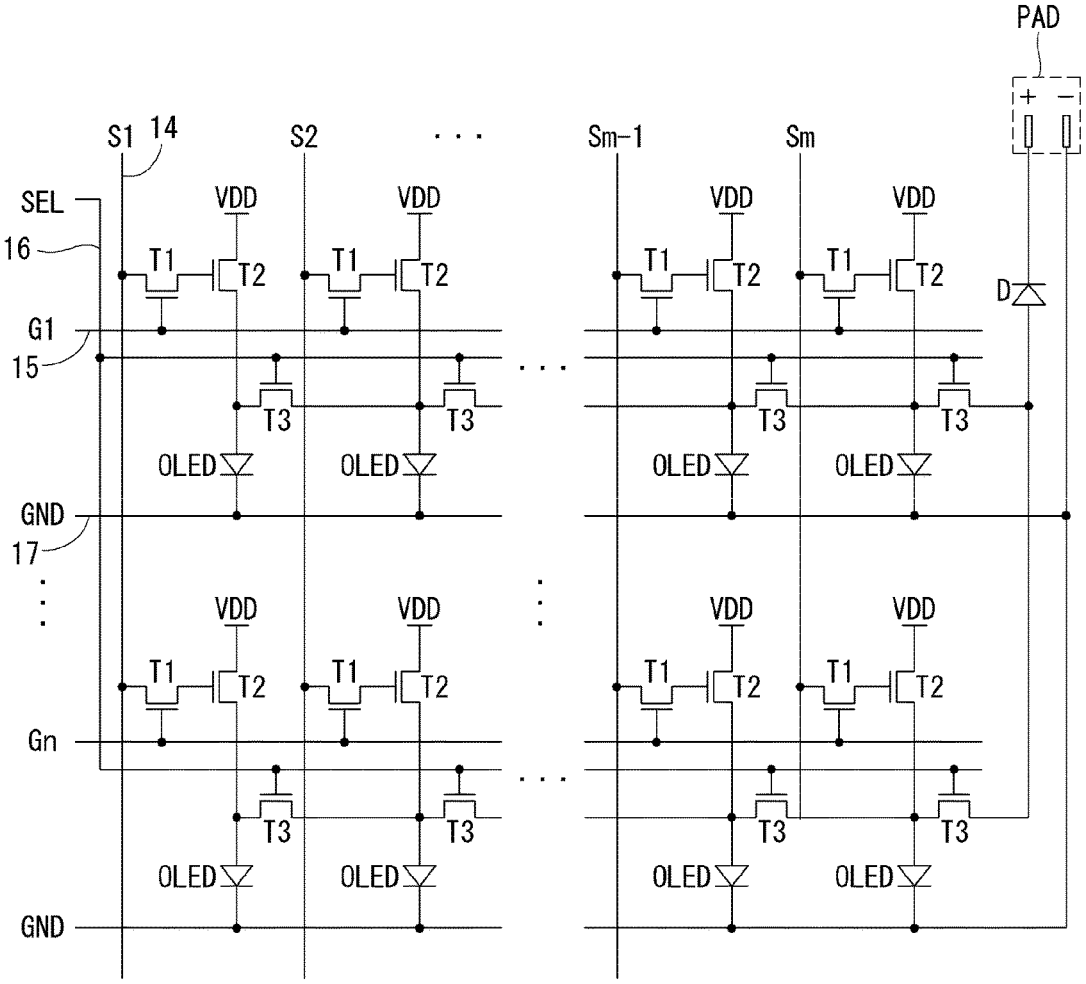
FIG. 3 is an equivalent circuit diagram of a pixel array shown in FIG. 2.

FIG. 2 is a block diagram of an organic light emitting diode display according to an embodiment of the invention, and FIG. 3 is an equivalent circuit diagram of a pixel array shown in FIG. 2.

As shown in FIGS. 2 and 3, an organic light emitting diode (OLED) display according to an embodiment of the invention includes a display panel 10, a display panel driving circuit, a battery 20, and a power unit 30. All the components of the OLED display in this and all other embodiments discussed herein are operatively coupled and configured.

The OLED display includes an image mode for displaying images, and an electricity generation mode for generating electric power using the display panel 10, where such electric power can be supplied to power one or more components of the OLED display. The image mode and the electricity generation mode are mutually exclusive and non-overlapping. For instance, when the display panel 10 is in the display mode, the display panel 10 is not in the electricity generation mode, and when the display panel is in the electricity generation mode, the display panel is not in the display mode. In one example, when the display panel 10 is in a sleep mode or other non-displaying mode, then the display panel 10 is preferably in the electricity generation mode. A pixel array of the display panel 10 displays data of an input image in the image mode, and generates electric power in the electricity generation mode. More specifically, in the image mode, pixels P of the pixel array are separated from one another and independently display pixel data. The image mode indicates a normal display function/operation of the display panel 10 for displaying images in the pixel array.

In the electricity generation mode, the pixels P of the pixel array generate electricity using ambient light that is received or absorbed by organic light emitting diodes (OLEDs) of the pixels P. The electricity generation mode is an operation mode for producing the electric power through the pixel array during a period, in which the input image is not displayed on the pixel array. For instance, during a sleep mode or other non-displaying mode while the device is turned on, the device can operate in an electricity generation mode. In the electricity generation mode, all of the pixels P of the pixel array are connected to one another and operate as one organic solar cell for generating electric power. For instance, when the OLED display is in the electricity generation mode, all the pixels P of the pixel array are electrically connected to each other and thus can operate as an organic solar cell, which is one of the advantageous features of the present invention.

The pixel array of the display panel 10 includes a plurality of data lines 14, a plurality of scan (or gate) lines 15 crossing the data lines 14, a ground line 17, and the pixels P arranged in a matrix form. Each pixel P may include a red subpixel R, a green subpixel G, and a blue subpixel B for the color representation. Further, each pixel P may further include a white subpixel W. In FIG. 3, S1 to Sm denote the data lines 14, and G1 to Gm denote the gate lines 15.

The display panel 10 further includes a common connection line 16 formed on the pixel array and a battery connection pad PAD connected to the common connection line 16. The common connection line 16 connects gates of third thin film transistors (TFTs) T3 of all of the pixels to each other. On the common connection line 16, a selection signal SEL is applied in the electricity generation mode. For instance, the selection signal SEL for turning on the third TFTs T3 of all of the pixels is applied to the common connection line 16 in the electricity generation mode (but not in the image mode). This selection signal SEL is then used to electrically connect the anodes of all OLEDs of all pixels P to each other and to the battery connection pad PAD by turning on the third TFTs T3. The anodes of the OLEDs can be referred to as first terminals of the OLEDs and the cathodes of the OLEDs can be referred to as second terminals of the OLEDs.

The anodes of OLEDs of all of the pixels are connected to a positive pad (+) of the battery connection pad PAD through the third TFTs T3. The ground line 17 connects cathodes of the OLEDs of all of the pixels, and the cathodes of the OLEDs of all of the pixels are connected to a negative pad (−) of the battery connection pad PAD. The positive pad (+) and the negative pad (−) of the battery connection pad PAD can be referred as first and second terminals of the pad PAD, respectively. A ground level voltage GND or a low potential power voltage VSS is supplied to the cathodes of the OLEDs through the ground line 17.

The battery connection pad PAD is preferably formed in a non-display area outside the pixel array, but may be located elsewhere. The selection signal SEL is a selection signal applied to the common connection line 16. The positive pad (+) of the battery connection pad PAD is connected to a positive terminal of the battery 20. The negative pad (−) of the battery connection pad PAD is connected to the ground line 17 and to a negative terminal of the battery 20. Thus the battery 20 can then be charged by the electric power supplied from the battery connection pad PAD, which will be discussed more below.

Figure 1:
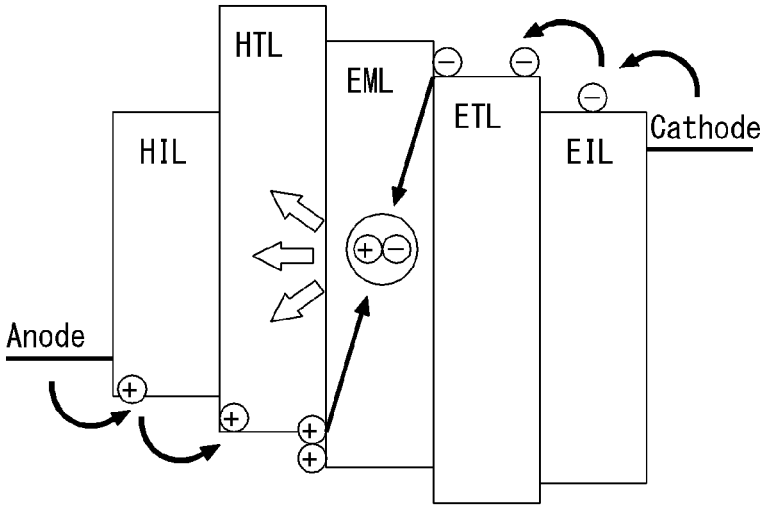
FIG. 1 (RELATED ART)
FIG. 1 shows a structure and an emission principle of an organic light emitting diode according to a related art.

Each pixel P of the pixel array includes an OLED (organic light emitting diode). Each pixel P also includes a pixel driving circuit, which drives the corresponding OLED depending on a data voltage of the input image in the image mode, and also connects the anodes of all the OLEDs in the electricity generation mode of the present invention. For example, each of the pixel driving circuits may include three TFTs T1, T2, and T3 and one storage capacitor Cst, but the invention is not limited thereto. For example, each pixel P may further include an internal compensation circuit for compensating for a deviation of threshold voltages of driving TFTs (e.g., the second TFTs T2). The OLED in each pixel P according to an embodiment of the present invention may be configured so that organic compound layers including a hole injection layer HIL, a hole transport layer HTL, an emission layer EML, an electron transport layer ETL, an electron injection layer EIL, etc. are stacked (e.g., as shown in FIG. 1).

The OLED of each pixel P operates as an emission cell, which emits light depending on a current supplied through the corresponding second TFT T2, in the image mode of the OLED display. On the other hand, the OLED of each pixel also operates as an organic solar cell in the electricity generation mode of the OLED display, and converts a received light into the electric current, thereby generating the electric power. A general principle, in which an OLED may operate as an emission cell and a solar cell, is described in an article entitled "ORGANIC PHOTOVOLTAIC CELLS: HISTORY, PRINCIPLE AND TECHNIQUES," J. C. Bernede, Lamp, FSTN, Universite de Nantes, 2 Rue de la Houssiniere, BP 92208, Nantes CEDEX 3, 44322, France. (Received: Dec. 4, 2007—Accepted), J. Chil. Chem. Soc., 53, N 3 (2008), which is herein incorporated by reference.

According to one or more embodiments of the present invention, the operation of the image mode and the operation of the electricity generation mode of the OLED display will now be explained in more detail referring to FIG. 3.

In the image mode, as shown in FIG. 3, for each pixel P, the first TFT T1 applies a data voltage input through the corresponding data line 14 to a gate of the second TFT T2 in response to a scan pulse (from the corresponding scan line 15). A gate of the first TFT T1 is connected to the scan line 15, to which the scan pulse is applied. A drain of the first TFT T1 is connected to the data line 14, and a source of the first TFT T1 is connected to the gate of the second TFT T2.

The second TFT T2 operates as the driving TFT and adjusts an electric current flowing in the corresponding OLED depending on a gate voltage in the image mode. A high potential pixel power voltage VDD is applied to a drain of the second TFT T2. A source of the second TFT T2 is connected to the anode of the OLED. The first and second TFTs T1 and T2 are thus driven in the image mode and are used to display images in the image mode. In the image mode, however, the third TFT T3 are turned off and do not operate.

In the electricity generation mode, the first and second TFTs T1 and T2 are turned off and do not operate, while the third TFTs T3 are turned on (e.g., by the operation of the selection signal SEL on the common connection line 16). The third TFTs T3 and the common connection line 16 can be a switching circuit which selectively and electrically separates the anodes of the OLEDs of the adjacent pixels from one another. For instance, the switching circuit causes the adjacent pixels to be electrically separated from each other and independently driven in the image mode. On the other hand, in the electricity generation mode when the device is not actively displaying images on the pixels, the switching circuit commonly and electrically connects the anodes of all the OLEDs to the positive pad (+) of the battery connection pad PAD and operates the OLEDs as the organic solar cell.

The third TFT T3 maintains an Off-state in the image mode. Thus, in the image mode, the OLEDs of the pixels are separated from one another and are independently driven.

In the electricity generation mode, the third TFTs T3 are turned on and thereby connect the anodes of all the OLEDs of all the pixels P to the positive terminal of the battery 20 in response to the selection signal SEL. The embodiment of the invention electrically connects the anodes of all the OLEDs of all of the pixels using the third TFTs T3 and thus increases the efficiency of the solar cell without making changes in the structure of the OLED. For instance, in the electricity generation mode, the selection signal SEL is generated by a timing controller 11 and is supplied to all the third TFTs T3 of the pixels. This then turns on all the third TFTs T3 while all the first and second TFTs T1 and T2 are turned OFF. Due to the turned-on third TFTs T3, then all the anodes of all the OLEDs are electrically connected to each other and to the battery 20 through the battery connection pad PAD in the electricity generation mode. As a result, in the electricity generation mode the electric current from all the OLEDs then charges the battery 20, and the charged battery 20 can supply electric power to one or more components of the OLED display, e.g., via the power unit 30.

As discussed above, the gate of each third TFT T3 in each pixel P is connected to the common connection line 16. The drain of each third TFT T3 in each pixel P is connected to an anode of the corresponding OLED included in that pixel, and the source of the same each third TFT T3 is connected to an anode of another OLED adjacent to the corresponding OLED or to the positive pad (+) of the battery connection pad PAD. On each line of the pixel array, the third TFT T3 of one pixel that is positioned close to the positive pad (+) is connected to the positive pad (+) of the battery connection pad PAD.

A diode D may be connected between the positive pad (+) of the battery connection pad PAD and the source of each third TFT T3. A cathode of the diode D is connected to the positive pad (+) of the battery connection pad PAD, and an anode of the diode D is connected to the source of each third TFT T3. Other variations are also possible with the diode D configurations and connections. The diode D supplies the current from the OLEDs to the positive pad (+) of the battery connection pad PAD in the electricity generation mode. The diode D blocks a reverse current flowing in the pixels P from the positive pad (+).

The display panel driving circuit of the OLED display according to the embodiment of the present invention includes a data driving circuit 12, a scan driving circuit 13, and the timing controller 11. The display panel driving circuit applies data of images to the pixel array of the display panel 10 in the image mode so that the display panel 10 displays the images in the image mode.

The data driving circuit 12 includes one or more source driver integrated circuits (ICs). The data driving circuit 12 is driven in the image mode and supplies the data voltage of the input image to the data lines 14. The data driving circuit 12 converts pixel data DATA of the input image received from the timing controller 11 into an analog gamma compensation voltage using a digital-to-analog converter (DAC) and generates the data voltage. The data driving circuit 12 outputs the data voltage to the data lines 14.

The scan driving circuit 13 is driven in the image mode and sequentially supplies the scan pulse synchronized with the data voltage to the scan lines 15. The scan driving circuit 13 sequentially shifts the scan pulse and sequentially selects the pixels, to which data is applied, on a per line basis.

The timing controller 11 receives the pixel data DATA of the input image and input timing signals from a host system. The input timing signals can include a vertical sync signal Vsync, a horizontal sync signal Hsync, a data enable signal DE, a dot clock DCLK, and the like. The timing controller 11 generates timing control signals DDC and GDC for respectively controlling operation timings of the data driving circuit 12 and the scan driving circuit 13 based on the input timing signals (e.g., Vsync, Hsync, DE, and DCLK) received along with the pixel data DATA of the input image.

The data enable signal DE is input to the timing controller 11 in synchronization with the pixel data DATA of the input image. Thus, the timing controller 11 may decide whether or not the input image is received based on the data enable signal DE.

According to an embodiment of the present invention, when the pixel data DATA of the input image is not received, the timing controller 11 operates in the electricity generation mode and supplies the selection signal SEL to the common connection line 16. Hence, the pixels P are electrically connected to one another in the electricity generation mode for generation and accumulation of electric current by the OLEDs.

The host system may be implemented as one of a television system, a set-top box, a navigation system, a DVD player, a Blu-ray player, a personal computer (PC), a home theater system, and a phone system.

The battery 20 is charged by the electric current received from the OLEDs of the pixels in the electricity generation mode, and the charged battery 20 may supply power to one or more components of the OLED display (via the power unit 30) or may supply power to an external device. Further, the battery 20 may be charged by a current from an external power unit.

The power unit 30 rectifies an input voltage from the battery 20 and generates a DC (direct current) input voltage. The power unit 30 generates voltages required to drive the display panel 10, for example, power voltages of the host system, the timing controller 11, the data driving circuit 12, and the scan driving circuit 13, a gamma reference voltage, a high voltage of the scan pulse, a low voltage of the scan pulse, etc. using a DC-DC converter, a charge pump, a regulator, etc.

According to an embodiment, in the electricity generation mode, the OLEDs can absorb an ambient light surrounding the OLED display to generate electric current. For instance, when the OLED display is in the electricity generation mode (e.g., in a non-displaying mode), a sunlight or other ambient light may surround the OLED display when the panel is left exposed to the outside (e.g., the panel is not covered). Then in this electricity generation mode, the OLEDs can absorb the sunlight or other ambient light nearby and use it to generate electric current. This occurs only during the electricity generation mode (e.g., when the display is in a sleep mode), and not during the image mode.

Figure 4:
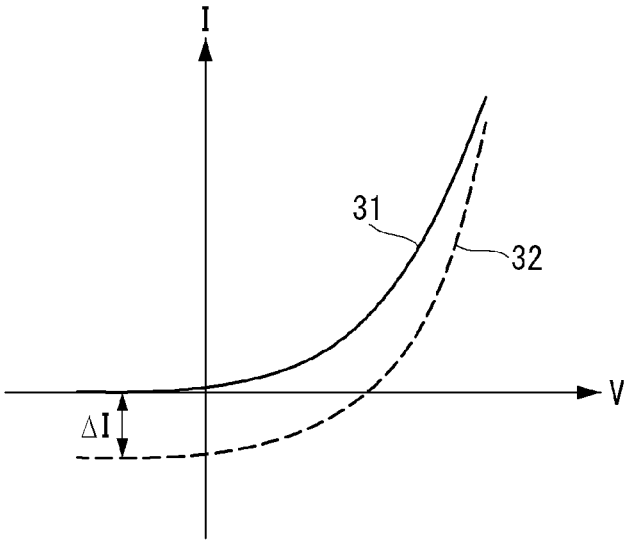
FIG. 4 shows a current-voltage curve of an organic light emitting diode according to an embodiment of the invention.

FIG. 4 shows a current-voltage curve of an OLED in the OLED display according to an embodiment of the invention. In FIG. 4, a reference numeral "31" indicates a current-voltage curve when no ambient light surrounds or impinges on the OLED (e.g., the display is located in the dark), and a reference numeral "32" indicates a current-voltage curve when the ambient light impinges on and is absorbed by the OLED in the electricity generation mode. Accordingly, in the electricity generation mode, the ambient light may be absorbed by the OLEDs which in turn cause the OLEDs to generate electric current, where the OLEDS operate as a solar cell.

In FIG. 4, "ΔI" indicates a difference between the currents generated depending on whether or not the OLED absorbs the ambient light. For each OLED of the OLED display, the current flows in the OLED when a voltage equal to or greater than a threshold voltage is applied to the OLED, and as a result, the OLED emits a light in the image mode and does not absorb any ambient light. On the other hand, in the electricity generation mode (e.g., when the display is not displaying), the ambient light surrounding the OLEDs is absorbed by the OLEDs, which in turn causes a generation of a small electric current flows in the OLED. However, because such a small amount of electric current flows in the OLED when the ambient light is irradiated onto the OLED, the OLED itself does not emit light. The embodiment of the invention electrically connects the OLEDs of all of the pixels in the electricity generation mode and adds such currents generated from the OLEDs of all of the pixels to the battery connection pad PAD. The embodiment of the invention then charges the battery 20 by the added current from the OLEDs via the battery connection pad PAD.

As described above, the embodiment of the invention charges the battery by the current of the OLED generated when an ambient light is absorbed by the OLED during a period in which the OLED itself does not emit light (i.e., during the electricity generation mode), and thus can generate the electric power using the OLEDs. Further, since the embodiment of the invention electrically and selectively connects the OLEDs of all of the pixels in the electricity generation mode, this can increase the electricity generation efficiency without changing the structure of the OLEDs.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising:

a plurality of pixels configured to operate in an image mode for displaying images, and in an electricity generation mode for generating an electric current, each pixel including:

an organic light emitting diode; and a pixel driving circuit, wherein the pixel driving circuit electrically separates the corresponding light emitting diode from one or more adjacent organic light emitting diodes in the image mode, and electrically connects the corresponding light emitting diode to the one or more adjacent organic light emitting diodes in the electricity generation mode, and wherein the pixel driving circuit is configured to cause the corresponding organic light emitting diode to emit light depending on a data voltage of an input image in the image mode, and to supply an electric current generated in the corresponding organic light emitting diode to a battery in the electricity generation mode.

2. The organic light emitting diode display of claim 1, wherein for each pixel, the pixel driving circuit includes a first thin film transistor (TFT), a second TFT, and a third TFT.

3. The organic light emitting diode display of claim 2, wherein for each pixel, the first TFT applies the data voltage input through a data line to a gate of the second TFT in response to a scan pulse in the image mode, wherein the second TFT adjusts an electric current flowing in the organic light emitting diode depending on a gate voltage in the image mode, and wherein the third TFT electrically connects an anode of the corresponding organic light emitting diode and an anode of each of the one or more adjacent organic light emitting diodes of adjacent pixels to a positive pad in the electricity generation mode.

4. The organic light emitting diode display of claim 3, further comprising:

a common connection line configured to connect gates of the third TFTs of the adjacent pixels; and a ground line configured to connect cathodes of the organic light emitting diodes of the adjacent pixels to a negative pad, wherein a positive terminal of the battery is connected to the positive pad, and a negative terminal of the battery is connected to the negative pad.

5. The organic light emitting diode display of claim 4, wherein each third TFT is turned on in response to a selection signal supplied through the common connection line in the electricity generation mode, and the turned-on third TFTs electrically connect the anodes of the organic light emitting diodes to the positive pad.

6. The organic light emitting diode display of claim 5, wherein a gate of each third TFT is connected to the common connection line, wherein a drain of a specific third TFT is connected to an anode of a first organic light emitting diode, and wherein a source of the specific third TFT is connected to an anode of a second organic light emitting diode adjacent to the first organic light emitting diode or to the positive pad.

7. The organic light emitting diode display of claim 6, further comprising a diode connected between the positive pad and the source of the specific third TFT.

8. The organic light emitting diode display of claim 1, wherein the pixels do not display images in the electricity generation mode.

9. An organic light emitting diode display comprising:

a plurality of pixels configured to operate in an image mode for displaying images and in an electricity generation mode for generating an electric current, each pixel including an organic light emitting diode, a first thin film transistor (TFT), a second TFT, and a third TFT;

a common connection line connected to the third TFTs of adjacent pixels, and configured to supply a selection signal to the third TFTs in the electricity generation mode; and a ground line connected to first terminals of the organic light emitting diodes of the adjacent pixels, wherein the first terminals of the organic light emitting diodes of the adjacent pixels are connected to one another through the ground line and are commonly connected to a battery and second terminals of the organic light emitting diodes of the adjacent pixels that are connected to one another through the third TFTs and are commonly connected to the battery so that electric current from the organic light emitting diodes charges the battery, and wherein the plurality of pixels do not display images in the electricity generation mode and operate as one organic solar cell for generating electric power.

10. The organic light emitting diode display of claim 9, wherein for each pixel, the first TFT applies a data voltage input through a data line to a gate of the second TFT in response to a scan pulse in the image mode, and the second TFT adjusts an electric current flowing in the organic light emitting diode depending on a gate voltage in the image mode, and wherein the third TFTs connect the second terminals of the organic light emitting diodes of the adjacent pixels to the battery in the electricity generation mode.

11. The organic light emitting diode display of claim 9, wherein in the electricity generation mode, the first and second TFTs are turned off while the third TFTs are turned on by the selection signal.

12. The organic light emitting diode display of claim 9, further comprising a timing controller, wherein when pixel data of the images are not received, the timing controller operates in the electricity generation mode and thereby generates and supplies the selection signal to the common connection line.

* * * * *